US007243383B1

(12) United States Patent
Hennessy

(10) Patent No.: US 7,243,383 B1
(45) Date of Patent: Jul. 17, 2007

(54) MODULAR SUPERSTRUCTURE FOR SUPPORTING MULTIPLE HAMMOCKS

(75) Inventor: Thomas F. Hennessy, Galiano Island (CA)

(73) Assignee: Hennessy Holdings, Ltd., Galiano Island, British Columbia (CA)

( * ) Notice: Subject to any disclaimer, the term of this patent is extended or adjusted under 35 U.S.C. 154(b) by 0 days.

(21) Appl. No.: 11/362,265

(22) Filed: Feb. 24, 2006

(51) Int. Cl.
*A45F 3/24* (2006.01)

(52) U.S. Cl. ..... 5/127; 5/130

(58) Field of Classification Search ..... 5/9.1, 5/120–123, 127–130; 482/35, 36; 135/96
See application file for complete search history.

(56) References Cited

U.S. PATENT DOCUMENTS

| | | | | | |
|---|---|---|---|---|---|
| 34,931 | A | * | 4/1862 | Timmons et al. | 5/121 |
| 627,626 | A | * | 6/1899 | Owens | 5/128 |
| 851,927 | A | * | 4/1907 | Fyfe | 5/128 |
| 1,346,973 | A | | 7/1920 | Padden | |
| 1,434,841 | A | * | 11/1922 | Pittoni | 5/130 |
| 1,471,465 | A | * | 10/1923 | Hinton | 482/36 |
| 1,732,154 | A | | 10/1929 | Cunningham | |
| 1,961,915 | A | | 6/1934 | Salmen, Jr. | |
| 2,126,636 | A | * | 8/1938 | Horne | 482/36 |
| 2,251,299 | A | | 8/1941 | Spangler | |
| 2,618,788 | A | | 11/1952 | Cole | |
| 3,376,879 | A | | 4/1968 | Huddle | |
| 5,035,012 | A | * | 7/1991 | Westrich | 5/139 |
| 5,423,341 | A | | 6/1995 | Brady | |
| 5,666,986 | A | | 9/1997 | Fox | |
| 5,701,616 | A | * | 12/1997 | Rosenquist | 5/8 |
| 5,755,641 | A | * | 5/1998 | Pardella | 482/36 |
| 6,470,518 | B1 | | 10/2002 | Ke | |
| 6,748,962 | B2 | | 6/2004 | Miller | |
| 2002/0153034 | A1 | | 10/2002 | Miller | |
| 2004/0222336 | A1 | | 11/2004 | Miller | |

* cited by examiner

*Primary Examiner*—Michael Trettel
(74) *Attorney, Agent, or Firm*—Shoemaker and Mattare

(57) ABSTRACT

A system of tripods, bipods and/or unipods is used to support a polygonal array of horizontal spars joined by connector hubs. The array may be extended indefinitely, in order to support a desired number of hammocks. As few as three different stock components are required. Each hammock is suspended from the structure by connecting its ends to a pair of the connector hubs.

12 Claims, 5 Drawing Sheets

MODULAR SUPERSTRUCTURE FOR SUPPORTING MULTIPLE HAMMOCKS

BACKGROUND OF THE INVENTION

This invention relates to a superstructure for supporting multiple hammocks.

Hammocks are most often used in wooded areas, where they can be hung from trees. Hammocks have the advantage of keeping a person off the ground, minimizing his contact with insects and ground moisture. Modern hammocks are inexpensive and very light—some only weigh a few ounces—and they promote air circulation, an advantage particularly in tropical conditions. However, not all locations have the trees needed for hammock use.

It would be beneficial to provide hammock users—particularly large groups of them, like Boy Scouts, adventure tourists and military units—with a lightweight superstructure from which they could suspend their hammocks, and which they could easily transport as needed.

SUMMARY OF THE INVENTION

An object of the invention is provided a structure for supporting multiple hammocks where trees are not available, or not plentiful, as in desert environments or on military bases.

Another object of the invention is to provide a hammock supporting structure which can be assembled quickly and without tools.

A further object is to provide a set of only a few different components from which hammock supporting structures if indefinite extent can be constructed.

These and other objects are attained by a superstructure for supporting multiple hammocks as described below.

BRIEF DESCRIPTION OF THE DRAWINGS

In the accompanying drawings.

DESCRIPTION OF THE PREFERRED EMBODIMENT

Figure 1:
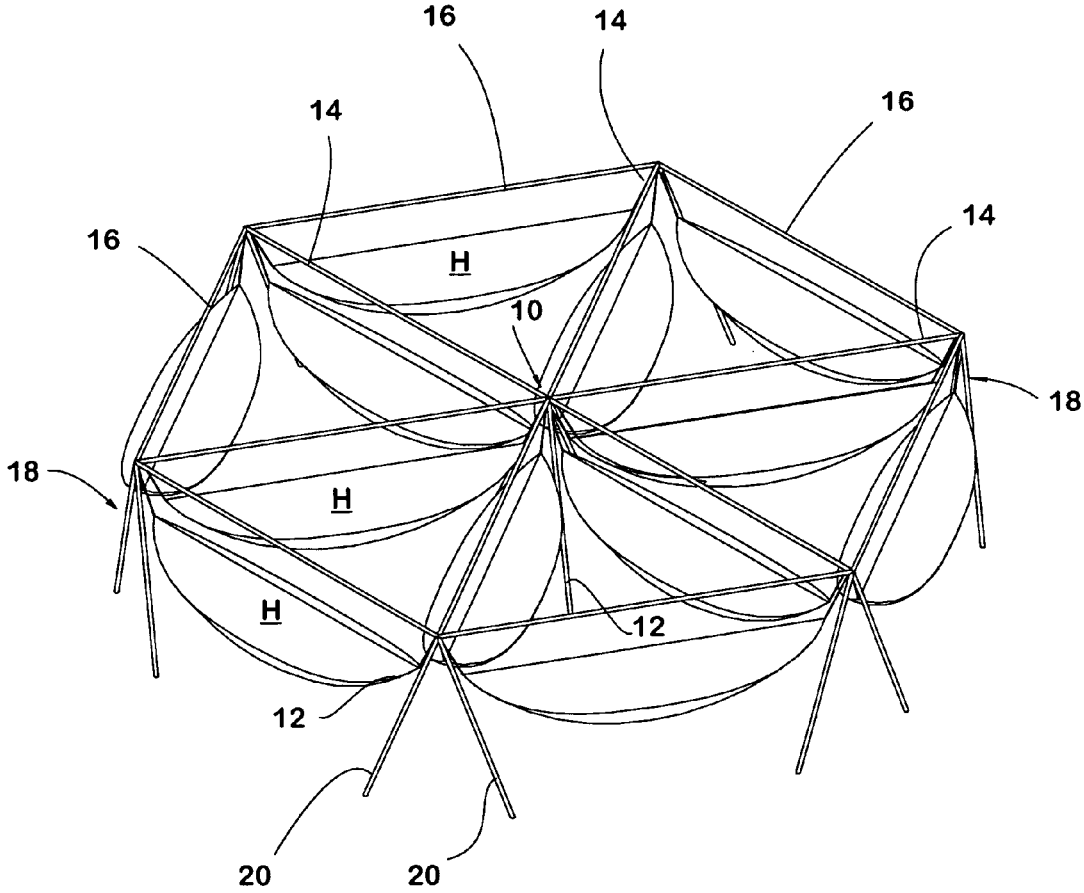
FIG. 1 is a perspective view of a superstructure for supporting multiple hammocks.

A simple example of the invention is shown in FIG. 1, where a structure for supporting multiple hammocks "H" comprises a central support 10 in the form of a tripod having at least three legs 12, plural radial spars 14 extending outward from the central support, peripheral spars 16 interconnecting the ends of neighboring radial spars, and peripheral supports 18, one at the end of each radial spar. The peripheral supports shown in this example are bipods formed from two legs 20. The spars may be thin-gauge aluminum tubes or other elongate structures having compression strength and stiffness sufficient to oppose the tension of loaded hammocks without buckling, once hammocks have been suspended from the structure.

While the inner ends of the peripheral spars shown in FIG. 1 are supported by a tripod, and the outer ends are supported by bipods, some of the supports might be unipods (single vertical tubes or legs). I use the word "stanchion" in a generic sense below, to mean a unipod, a bipod, or a tripod. Regardless of the number of legs it has, each stanchion has a connecting hub at its upper end which interconnects the legs (in the case of a bipod or tripod), and also has structure for receiving or attaching one or more spars.

In FIG. 1, the number of radial spars is six, but any number greater than two is possible. Six is advantageous because hexagons nest with others without wasting space, so an indefinite number of such structures can be joined together.

Figure 2:
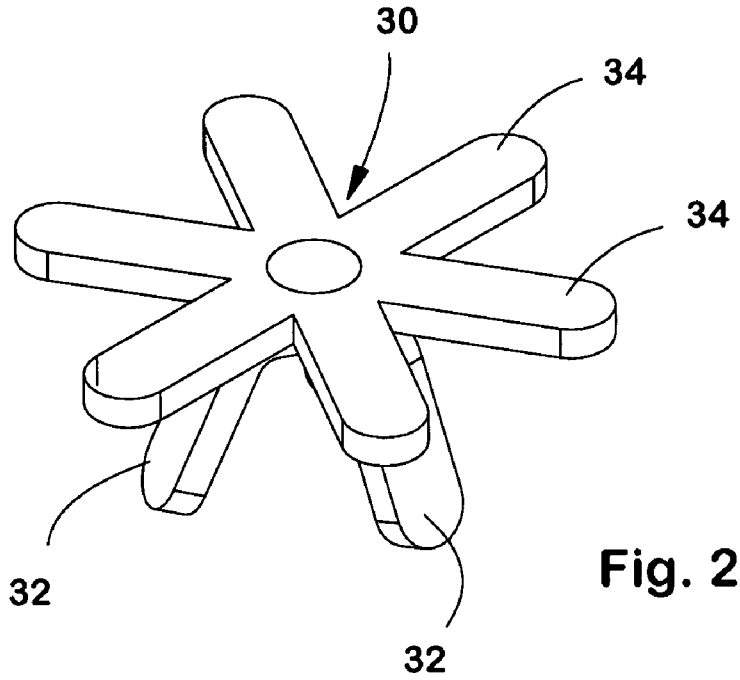
FIG. 2 shows a connecting hub thereof.
Figure 3:
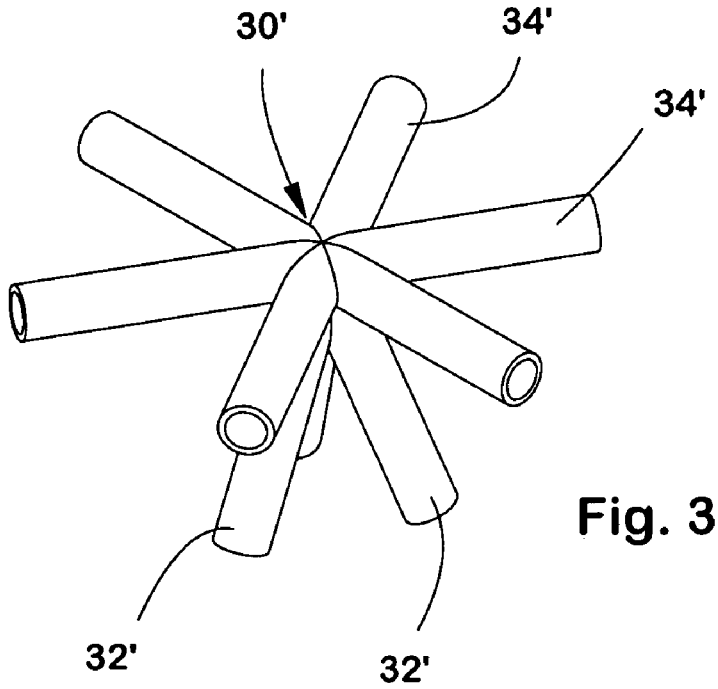
FIG. 3 shows a modified form of the connecting hub.
Figure 7:
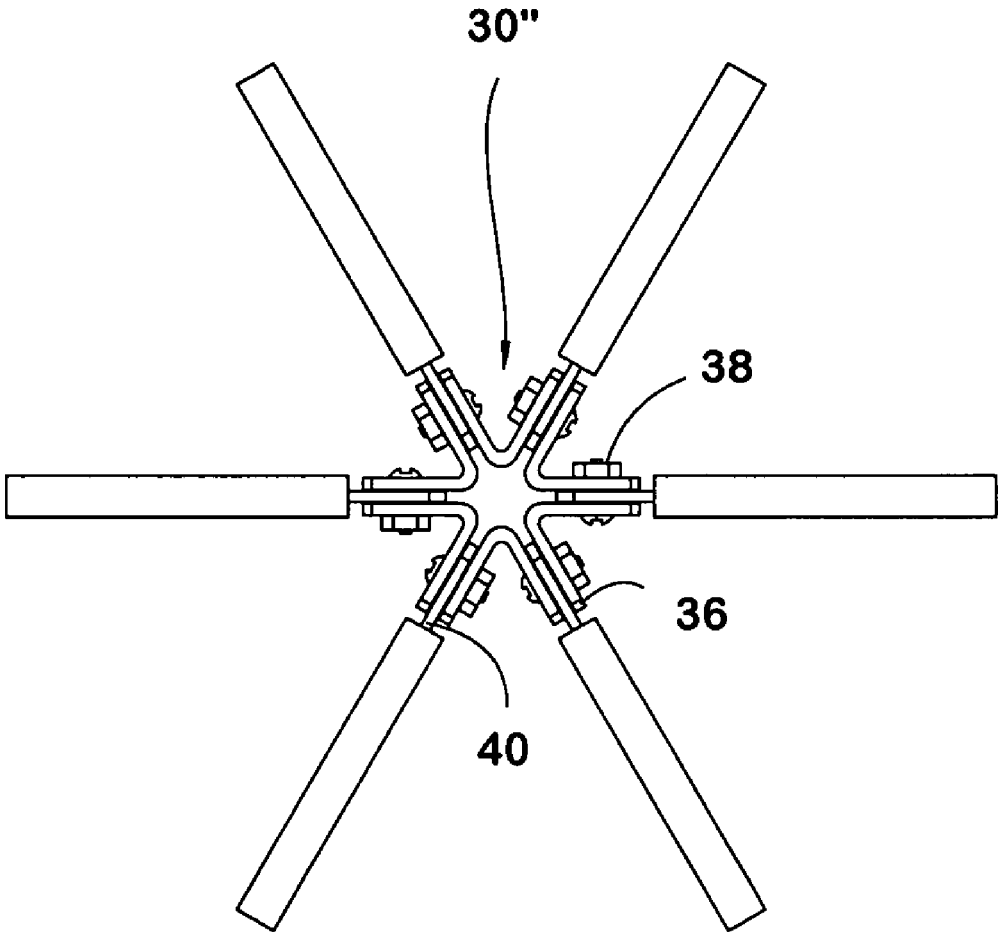
FIG. 7 shows another modified form of the connecting hub.

The legs 12, 20 and spars 14, 16 are interconnected by hubs, not shown in FIG. 1, FIG. 2 shows a connecting hub 30 in detail. It includes three downwardly extending tabs 32 which seat in the tops of the tripod legs, and six radially extending tabs 34, each of which seats in the inner end of one of the radial spars. The hub may have holes or hooks to which hammock ropes may be tied. Many alternative constructions for the connecting hub are possible. For example, the tabs could be replaced by other forms, such as the sockets 34', shown on the hub 30' in FIG. 3, for receiving the legs and spars. Or, as shown in FIG. 7, the hub 30" could be constructed by joining plural vee plates 36 with fasteners 38. The fasteners serve as pivot points for the ends 40 of the spars and legs, which in this case are flattened or have flat end inserts.

In use, hammocks are suspended between the tripod connecting hub and the bipod connecting hubs by looping the hammock suspension ropes over hooks or projections (illustrated) or through holes (not shown) in the hub and the bipod connectors.

If a good lone tree is available, it may be possible to use the tree trunk in lieu of the center tripod, with suitable modifications which would be within the skill of an ordinary person.

Figure 4:
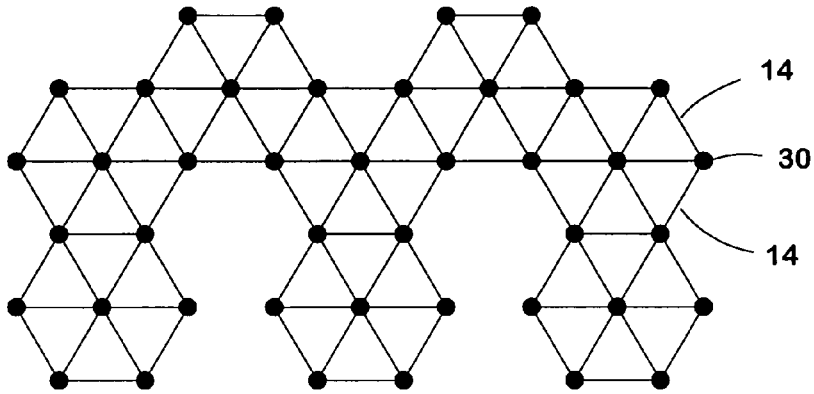
FIG. 4 shows a portion of a triangle-based array of indeterminate size.
Figure 5:
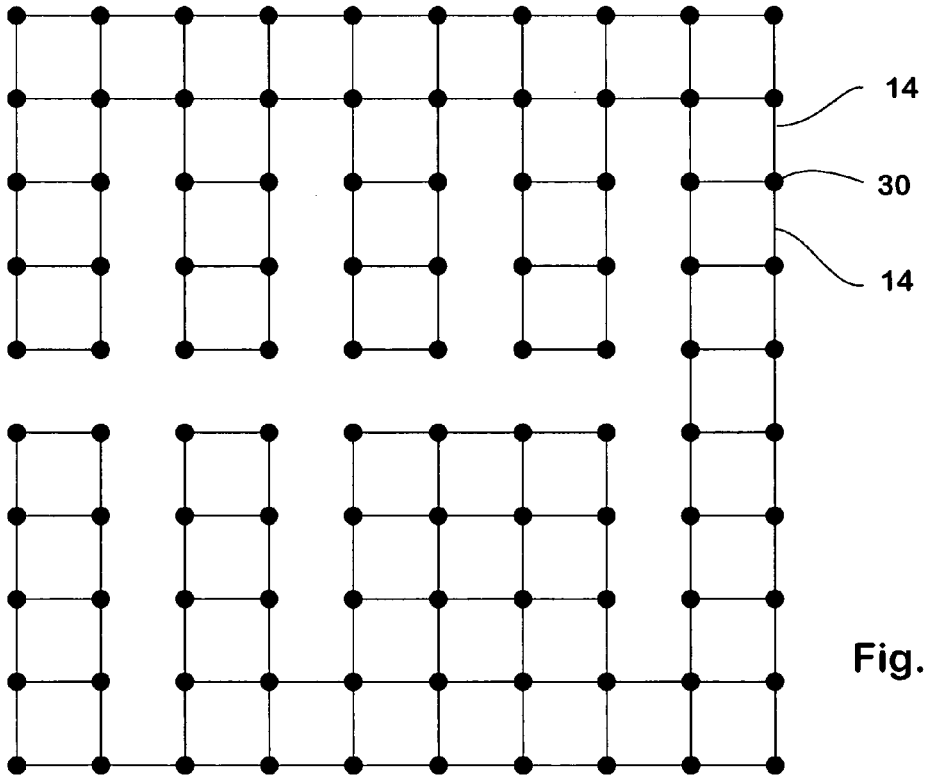
FIG. 5 shows a portion of a square-based array of indeterminate size.
Figure 6:
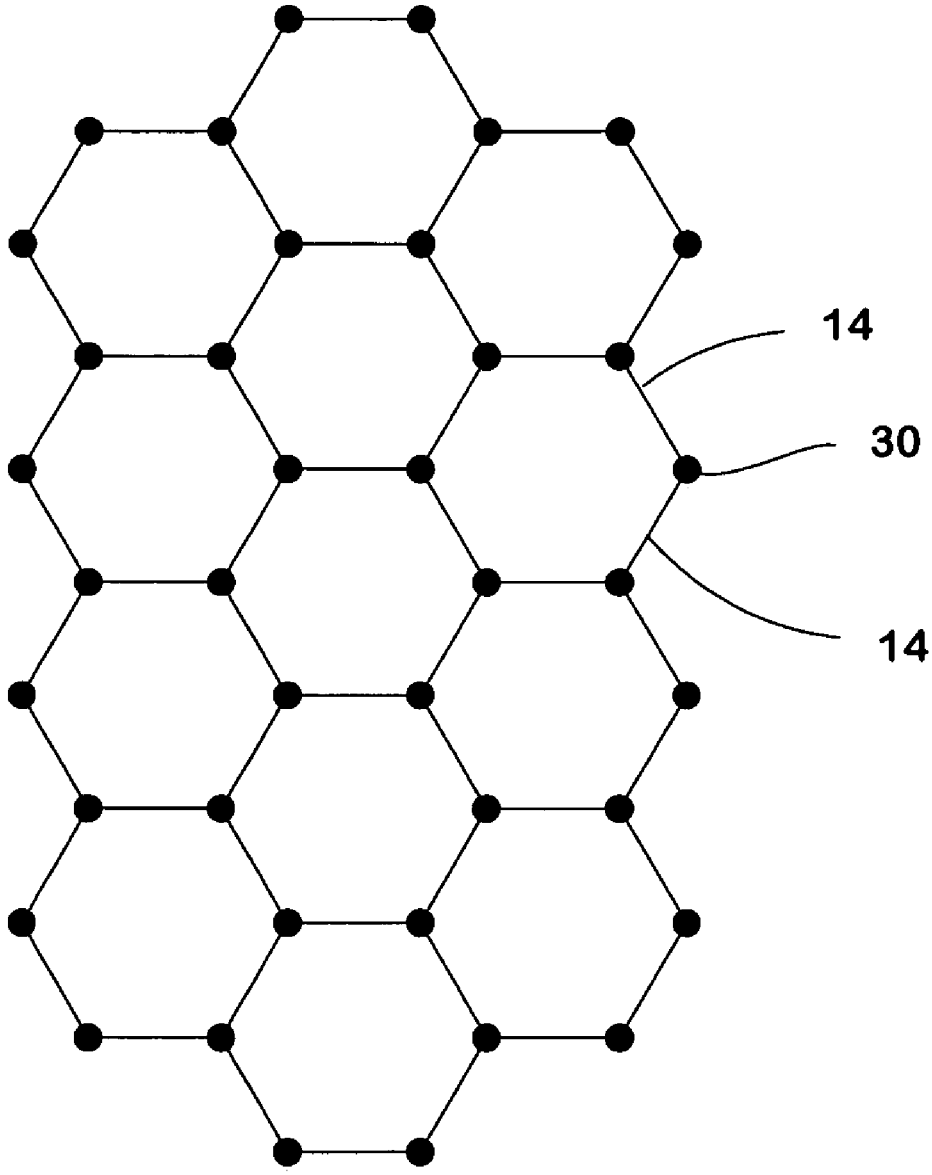
FIG. 6 shows a portion of a hexagon-based array of indeterminate size.

The invention is not limited to a hexagonal assembly. FIG. 4 shows an even simpler version of the invention, where the spars are arranged in an array of equilateral triangles, and FIG. 5 depicts an arrangement with four supports arranged in a square. A hexagonal array is illustrated in FIG. 6.

I prefer that all the spars of the invention be identical, and that therefore the polygons making up the array be regular polygons (all equilateral triangles, all squares, or all regular hexagons), but other arrangements are possible. Making all the spars identical has the advantage of minimizing the number of different parts which must be kept on hand, and simplifying construction. Similarly, I prefer that all the legs be identical, although on hilly ground it may be necessary to use some legs of different lengths. One can compensate for minor variations in ground contour, simply by altering the leg angles. For this reason, it is preferred that the hubs be made of a strong but flexible material, such as a hard rubber or plastic, or that they have free play or some other way of allowing the leg angles to be changed according to ground contour.

The number of tubes or legs at each supporting location may be judiciously chosen to minimize the number of legs per hammock, without making the structure unstable. Plainly, using only unipods as supports will not work, since without any diagonal bracing, the structure would collapse sideways under load ("racking" failure). On the other hand, tripods are not required at every support point. It can be shown that for a polygonal spar arrangement having N spars, a minimum of 2N supporting legs are required. For example, three spars forming a triangle can be supported at one vertex by a tripod, at one vertex by a bipod, and at the remaining vertex by a unipod, and be stable in all directions. A square can be supported by tripods at opposite corners, and unipods at the other two corners. Thus, an array may be constructed in which only some of the stanchions are tripods, the remainder being bipods and/or unipods.

An advantage of the invention is that it enables one to build a hammock-supporting structure of indefinite or limitless size from as few a three different stock components (legs, spars, connecting hubs).

Since the invention is subject to modifications and variations, it is intended that the foregoing description and the accompanying drawings shall be interpreted as only illustrative of the invention defined by the following claims.

I claim:

1. A structure for supporting multiple hammocks, said structure comprising a plurality of substantially horizontal spars and a plurality of stanchions for supporting the plurality of spars a distance above the ground, each of said stanchions having one or more legs and a connector at its upper end for interconnecting said legs and supporting an end of at least two of said horizontal spars wherein said connector has means for permitting angular adjustment of said legs with respect to one another.

2. The invention of claim 1, wherein each connector has at least one hole to which a hammock end may be attached.

3. The invention of claim 1, wherein each connector has at least one hook to which a hammock end may be attached.

4. A structure for supporting multiple hammocks, said structure comprising a plurality of substantially horizontal spars and a plurality of stanchions for supporting the plurality of spars a distance above the ground, each of said stanchions having one or more legs and a connector at its upper end for interconnecting said legs and supporting an end of at least two of said horizontal spars wherein said connector is made of a flexible material so as to permit angular adjustment of the legs with respect to one another.

5. A structure for supporting multiple hammocks, said structure comprising a plurality of substantially horizontal spars and a plurality of stanchions for supporting the plurality of spars a distance above the ground, each of said stanchions having one or more legs and a connector at its upper end for interconnecting said legs and supporting an end of at least two of said horizontal spars wherein the spars are arranged to form, when viewed from above, a plurality of congruent triangles.

6. The invention of claim 5, wherein at least one of the stanchions has three or more legs.

7. The invention of claim 5, wherein at least one of the stanchions comprises three legs joined at their upper ends to form a tripod.

8. The invention of claim 5, wherein the total number of legs in the structure is at least twice the total number of spars.

9. The invention of claim 5, wherein the total number of legs in the structure is twice the total number of spars.

10. The invention of claim 5, wherein all of the connectors are identical to one another.

11. The invention of claim 5, wherein only some of said stanchions are tripods.

12. The invention of claim 5, wherein some of said stanchions are bipods.

* * * * *